US009500421B1

(12) United States Patent
Geissele

(10) Patent No.: US 9,500,421 B1
(45) Date of Patent: Nov. 22, 2016

(54) FIREARM CHARGING HANDLE

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/816,390

(22) Filed: Aug. 3, 2015

Related U.S. Application Data

(63) Continuation-in-part of application No. 29/532,114, filed on Jul. 1, 2015.

(51) Int. Cl.
*F41A 3/72* (2006.01)

(52) U.S. Cl.
CPC ..... *F41A 3/72* (2013.01)

(58) Field of Classification Search
CPC ..... F41A 3/72
USPC ..... 89/1.4
See application file for complete search history.

(56) References Cited

U.S. PATENT DOCUMENTS 7,240,600 B1 7/2007 Bordson
7,832,322 B1 * 11/2010 Hoel ..... F41A 3/20 42/16
7,861,635 B1 1/2011 Hoel
7,900,546 B2 3/2011 Bordson
8,104,393 B2 1/2012 Kincel
8,261,649 B2 * 9/2012 Fitzpatrick ..... F41A 19/47 89/1.4
8,336,436 B2 12/2012 Kincel
8,356,537 B2 * 1/2013 Kincel ..... F41A 3/72 42/16
D694,354 S 11/2013 Underwood
D705,384 S 5/2014 Underwood
8,820,210 B2 * 9/2014 Melville ..... F41A 3/72 42/69.01
8,960,066 B2 * 2/2015 Gomez ..... F41A 3/72 42/43
D726,860 S 4/2015 Underwood
D738,452 S 9/2015 Underwood
D749,687 S 2/2016 Warensford

OTHER PUBLICATIONS

Highjack86, Rainier Arms Avalanche Ami Charging Handle—Preview/Initial Impressions, Jul. 16, 2015.*
ar15news, Sneak Peek!! Rainier Arms Avalanche Ami Charging Handle, ar15news.com, May 16, 2015.*
ar15news.com available at http://www.ar15news.com/2015/05/16/sneak-peek-rainier-arms-avalanche-ambi-charging-handle/ (May 22, 2015).

* cited by examiner

*Primary Examiner* — Stephen M Johnson
*Assistant Examiner* — Joshua Semick
(74) *Attorney, Agent, or Firm* — Merchant & Gould, P.C.

(57) ABSTRACT

A firearm charging handle includes a lever and an independently mobile latch partially disposed within the lever for improved usability and reliability.

20 Claims, 8 Drawing Sheets

FIREARM CHARGING HANDLE

CROSS-REFERENCE TO RELATED APPLICATIONS

This application is a continuation-in-part of U.S. patent application Ser. No. 29/532,114 filed Jul. 1, 2015 titled FIREARM CHARGING HANDLE, the disclosure of which is hereby incorporated by reference in its entirety.

BACKGROUND

Charging handles, also known as cocking handles or bolt handles, allow for manual adjustment of the bolt position in a firearm. Adjustment of the bolt position can effect proper operation of the firearm's firing cycle and efficient transitions between different stages of the firing cycle and/or between sequential firing cycles.

There is a need for improved and more user-friendly firearm charging handles.

SUMMARY

In general terms, this application is directed to a firearm charging handle having a central shaft configured to engage a bolt assembly, a latch, and lever for releasing the latch.

In one aspect, a firearm charging handle comprises: a front end; a back end; a body; a central shaft extending forwardly from the body, the central shaft being configured to engage a bolt assembly; a first lever pivotally coupled to the body and comprising an integrated slot therein, the slot pivoting in conjunction with the first lever; and a latch, the latch having a relaxed position and a released position and comprising a latch arm and a hook arm extending from the latch arm, at least a portion of the latch arm being disposed within the slot; wherein pivoting of the first lever pivots the latch arm within the slot; and wherein pivoting of the first lever moves the latch between the relaxed position and the released position.

In another aspect, a firearm charging handle comprises: a front end; a back end; a body; a central shaft extending forwardly from the body, the central shaft being configured to engage a bolt assembly; a first lever comprising a first pivot and a latch, the latch having a second pivot, a relaxed position and a released position, the first lever being pivotally coupled to the body about the first pivot, the latch being pivotally coupled to the body about the second pivot; and a second lever comprising a third pivot, the second lever being pivotally coupled to the body about the third pivot; wherein the third pivot is disposed rearward of the first pivot and of the second pivot; wherein the third pivot is disposed nearer the central shaft than the first pivot and the second pivot; and wherein pivoting of the first lever or the second lever moves the latch between the relaxed position and the released position.

In yet a further aspect, a firearm comprises: an upper receiver; a bolt assembly disposed within the upper receiver; and a charging handle, the charging handle comprising: a front end; a back end; a body; a central shaft extending forwardly from the body, the central shaft being configured to engage the bolt assembly and being at least partially housed in the upper receiver; a first lever comprising a first pivot and a latch, the latch having a second pivot, a latch arm, a hook arm extending from the latch arm, a relaxed position and a released position, the first lever further comprising an integrated slot therein, the first lever being pivotally coupled to the body about the first pivot, the latch being pivotally coupled to the body about the second pivot, the slot pivoting in conjunction with the first lever; and a second lever comprising a third pivot, the second lever being pivotally coupled to the body about the third pivot; wherein the third pivot is disposed rearward of the first pivot and of the second pivot; and wherein pivoting of the first lever or the second lever pivots the latch arm within the slot and moves the latch between the relaxed position and the released position.

DETAILED DESCRIPTION

Figure 1:
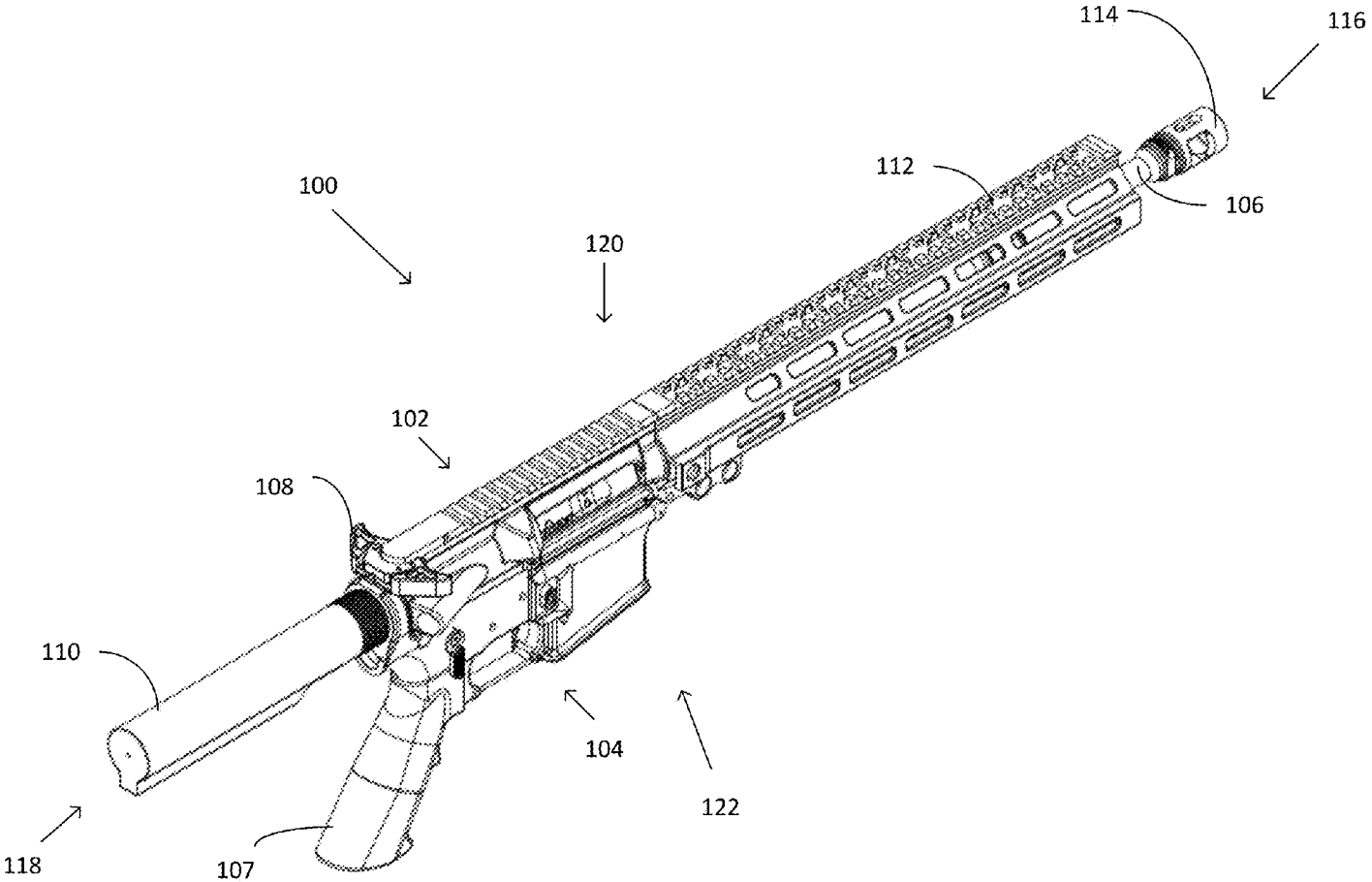
FIG. 1 is a perspective view of an example firearm having an example charging handle in a relaxed position in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example firearm 100 having an example charging handle in a relaxed position in accordance with the present disclosure. The firearm 100 includes an upper receiver 102, a lower receiver 104, a barrel 106, a grip 107 and a charging handle 108. Optionally, the firearm 100 also includes a buffer tube 110, a rail 112, and a muzzle brake 114. The firearm 100 is defined by a front 116, a back 118, a top 120 and a bottom 122. Throughout this disclosure, references to orientation (e.g., front(ward), rear (ward), in front, behind, above, below, high, low, back, top, bottom, under, underside, etc.) of structural components shall be defined by that component's positioning in FIG. 1 relative to, as applicable, the front 116, the back 118, the top 120, and the bottom 122 of the firearm 100, regardless of how the firearm 100 may be held and regardless of how that component may be situated on its own (i.e., separated from the firearm 100).

In some examples, the firearm 100 is configured to have a plurality of operating modes. Examples of operating modes include a normal mode and a semi-automatic mode. In normal mode, the firearm 100 discharges a round of ammunition following activation of a trigger mechanism. To reset the trigger mechanism to fire another round of ammunition, the user manually actuates the charging handle 108. In semi-automatic mode, the trigger mechanism automatically resets after firing each round of ammunition without needing to actuate the charging handle 108.

The firearm 100 can be of a variety of types. Examples of a firearm include handguns, rifles, shotguns, carbines, and personal defense weapons. In at least one embodiment, the firearm 100 is implemented as an AR-15 rifle or a variant of the AR-15.

The upper receiver 102 is configured to house a bolt assembly. In a typical firearm 100, the bolt assembly is slidably disposed in the upper receiver 102 for axially reciprocating recoil movement therein during the firing cycle sequence of the firearm 100. The barrel 106 is mated to the upper receiver 102, and the upper receiver 102 is in open communication with the barrel 106. During a firing cycle a firing pin carried by a bolt in the bolt mechanism is thrust forward to contact and discharge a cartridge loaded in a chamber in the upper receiver 102. A projectile (e.g., a bullet) from the cartridge then travels through the barrel 106 and exits the firearm 100 at the front end of the barrel 106 towards a target. The spent cartridge is ejected from the upper receiver 102 either automatically, or manually upon actuation of the charging handle 108.

The lower receiver 104 houses a trigger mechanism configured to initiate the firing cycle sequence of the firearm 100 when a predetermined amount of force is applied to a trigger bow. A magazine containing one or more rounds of ammunition (not shown) is coupled to the lower receiver 104 for depositing rounds of ammunition in the chamber of the upper receiver for each sequential firing cycle of the firearm 100.

The barrel 106 is positioned at the front 116 of the firearm 100 and is configured to be installed to the upper receiver 102. The barrel 106 provides a path to release an explosion gas and propel a projectile therethrough. In some embodiments, the barrel 106 includes an accompanying assembly that includes one or more of a rail system (e.g., the rail 112) for mounting accessories (e.g., a fore-grip, a flashlight, a laser, optic equipment).

The grip 107 provides a point of support for the shooter of the firearm and can be held by the shooter's hand, including when operating a trigger mechanism. The grip 107 assists the shooter in stabilizing the firearm 100 during firing and manipulation of the firearm 100. In some embodiments, the grip 107 is mounted to the lower receiver 104.

The charging handle 108 is slidably disposed within the upper receiver 102. A front portion of the charging handle 108 engages the bolt assembly within the upper receiver 102. A rear portion of the charging handle 108 is exterior to the upper receiver 102 and includes a hand engagement portion for actuating the charging handle 108. The charging handle 108 includes at least a relaxed position, in which the charging handle 108 is at its forward most limit within the upper receiver 102, and a pulled position, in which at least portion of the charging handle has been slid rearwards out of the upper receiver 102.

In FIG. 1, the charging handle 108 is shown in a relaxed position relative to the upper receiver 102. In some examples, the charging handle 108 is coupled to the interior of the upper receiver 102 by a biasing mechanism (e.g., a spring). In these examples, the biasing mechanism biases the charging handle 108 towards the relaxed position (shown in FIG. 1). Pulling the charging handle 108 rearwards to the pulled position creates a biasing force of the charging handle 108 towards the relaxed position. When the user releases the charging handle 108 from the pulled position (or otherwise reduces the applied force required to keep the charging handle 108 in the pulled position), the charging handle 108 reciprocates frontwards on the biasing force provided by the biasing mechanism towards the relaxed position.

The buffer tube 110 is disposed at the rear of the firearm 100 behind the upper receiver 102 and functions to reduce the recoil force associated with firing the firearm 100. In some embodiments, recoil is reduced by transferring the force to a spring or other biasing mechanism housed within the buffer tube 110.

The rail 112 surrounds at least a portion of the barrel 106 and functions as a support for the user's front hand when firing the firearm 100. The rail 112 may also act to prevent the user's hand from getting burned by the barrel 106, which can become extremely hot when the firearm 100 is being fired. As discussed above, the rail 112 may also be used for mounting accessories (e.g., a fore-grip, a flashlight, a laser, optic equipment).

The muzzle brake 114 is coupled to the front end of the barrel 106 and functions to redirect gases exiting the front of the barrel 106 during a firing cycle to reduce recoil, "kick," and/or the noise associated with firing the firearm 100.

Figure 2:
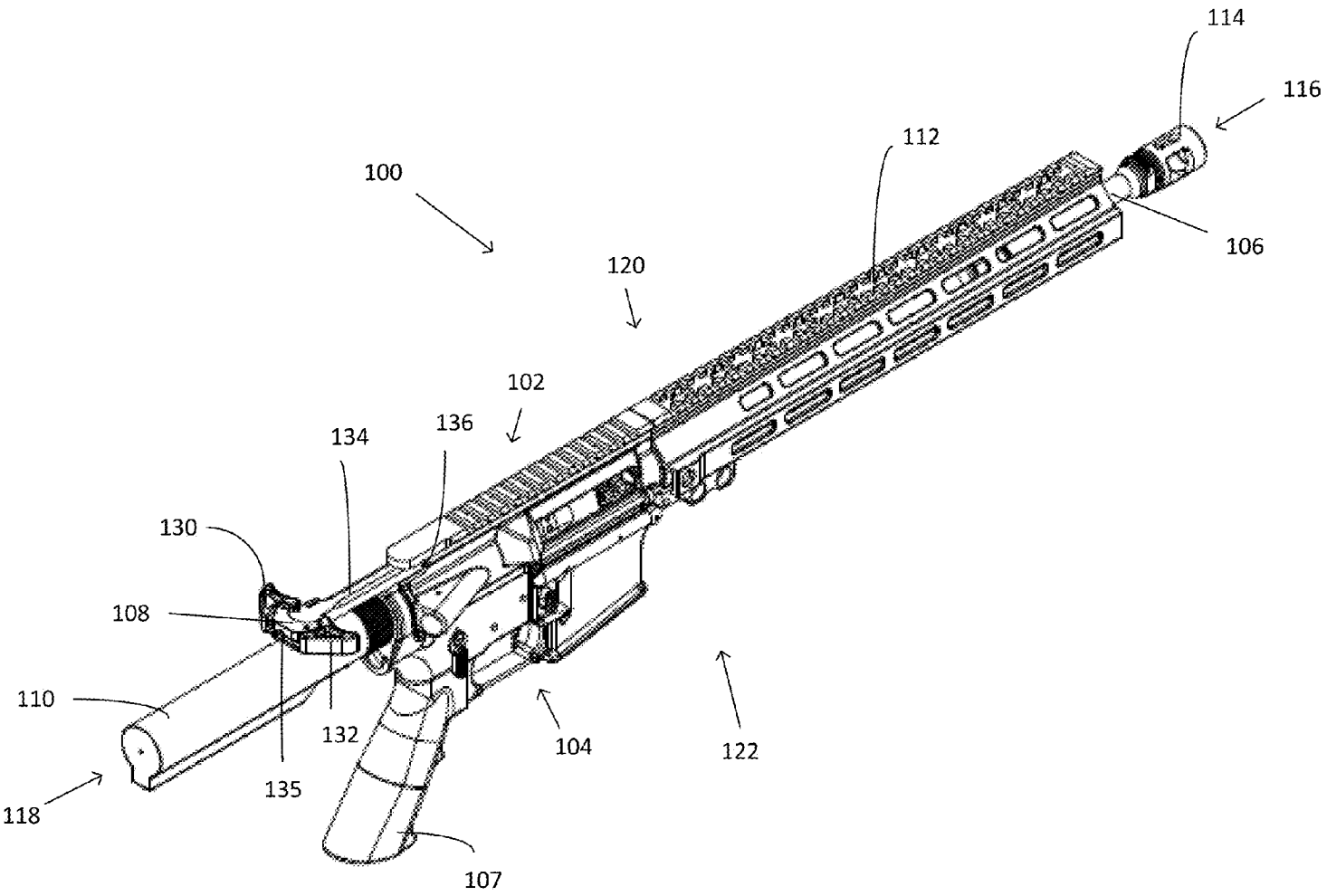
FIG. 2 is a perspective view of the example firearm of FIG. 1 with the charging handle of FIG. 1 in a pulled position.

FIG. 2 is a perspective view of the example firearm 100 of FIG. 1 with the charging handle 108 of FIG. 1 in a pulled position. The firearm 100 includes the upper receiver 102, the lower receiver 104, the barrel 106, the grip 107, the charging handle 108, the buffer tube 110, the rail 112, the muzzle brake 114, a front 116, a back 118, a top 120 and a bottom 122, as discussed above. In addition, in this example the charging handle 108 includes a first lever 130, a second lever 132, a central shaft 134, and a back end 135, and the upper receiver 102 includes a slot 136.

The first lever 130 and the second lever 132 are disposed behind the central shaft 134 towards the back end 135 of the charging handle 108. The first lever 130 and the second lever 132 are each pivotable relative to the central shaft 134. As discussed in more detail below, pulling one or both of the first lever 130 and the second lever 132 rearwards releases a latch on the charging handle 108 from engagement with the upper receiver 102, enabling the shooter to pull the charging handle 108 into the pulled position shown in FIG. 2. In some examples, when the charging handle 108 is in the relaxed position shown in FIG. 1, the entirety or a majority of the central shaft 134 is disposed within the slot 136 of the upper receiver 102. In some examples, when the charging handle 108 is in the pulled position shown in FIG. 2, at least a portion of the central shaft 134 is not disposed within the slot 136 and instead extends rearwardly from the upper receiver 102 as shown in FIG. 2.

Figure 3:
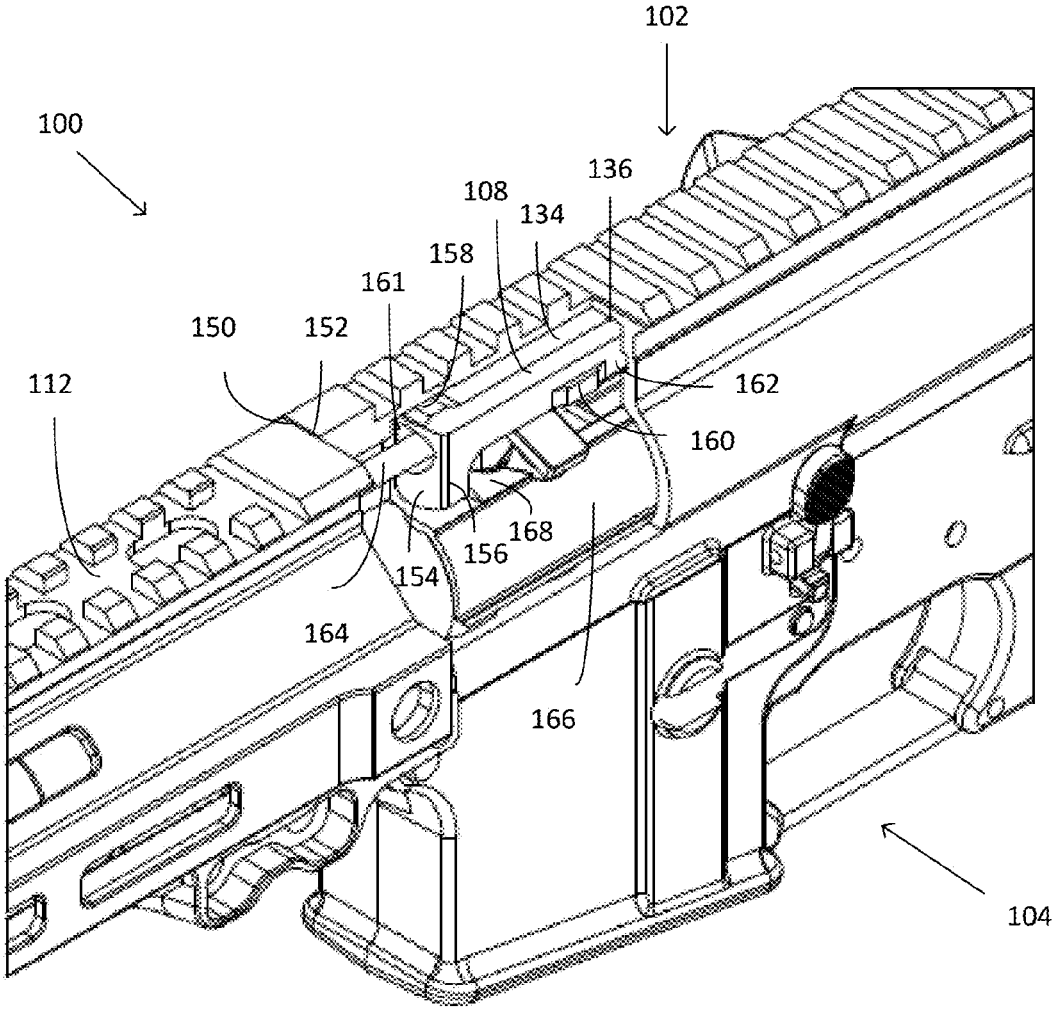
FIG. 3 is a perspective view of a portion of the upper receiver and the lower receiver of the firearm of FIG. 1 with a portion of the upper receiver removed to facilitate depiction of interior components.

FIG. 3 is a perspective view of a portion of the upper receiver 102 and the lower receiver 104 of the firearm 100 of FIG. 1 with a portion of the upper receiver removed to facilitate depiction of interior components. In this example, the firearm 100 includes the charging handle 108 and the rail 112; the charging handle 108 including the central shaft 134; and the upper receiver 102 including the slot 136, as discussed above. In addition, in this example, the upper receiver has a front end 150 that abuts a rear end 152 of the rail 112; the charging handle 108 includes a front end 154, a bolt assembly engaging portion 156, a top alignment mechanism 158, a side alignment mechanism 160, and an aperture 161; the upper receiver 102, includes a longitudinal recess 162; and the firearm 100 includes a spring spool 164 and a bolt assembly 166 having a charging handle engaging portion 168.

The bolt assembly engaging portion 156 is disposed toward the front end 154 of the charging handle 108. The bolt assembly engaging portion 156 engages the bolt assembly 166 by interfacing with the charging handle engaging portion 168. In some examples the charging handle engaging portion 168 is a projection from a bolt carrier, the bolt carrier being configured to carry a bolt of the bolt assembly 166.

The top alignment mechanism 158 assists in aligning the central shaft 134 in a particular direction within the slot 136. In some examples, the top alignment mechanism 158 is a projection extending from a top surface of the central shaft 134 that communicates with a corresponding groove in the upper receiver 102 for slidable forward and backward movement of the charging handle 108 relative to the upper receiver 102.

The side alignment mechanism 160 is disposed on a side of the central shaft 134 and also assists in aligning the central shaft 134 in a particular direction within the slot 136. In some examples the side alignment mechanism is a projection extending from a side surface of the central shaft 134 that communicates with the corresponding longitudinal recess 162 in the upper receiver 102 for slidable forward and backward movement of the charging handle 108 relative to the upper receiver 102. In some examples, for further improved alignment, an additional corresponding side alignment mechanism and longitudinal recess are also disposed on the opposing side (to that shown in FIG. 3) of the central shaft 134 and the upper receiver 102, respectively, and communicate with each other for slidable forward and backward movement of the charging handle 108 relative to the upper receiver 102.

The aperture 161 is disposed within the bolt assembly engaging portion 156 and receives the spring spool 164 therethrough. The spring spool 164 extends rearwardly from the front end 150 of the upper receiver 102, through the aperture 161 and at least partially along a longitudinal groove disposed in the underside of the central shaft 134. A biasing mechanism, (e.g., a spring), is positioned (e.g., coiled) about the spring spool 165. When the charging handle 108 is pulled rearwards, the spring stretches, biasing the charging handle 108 in the frontwards direction. Alternatively, a spring spool is not required and a spring is forwardly mounted to the front end 150 of the upper receiver 102, and rearwardly mounted to the charging handle 108.

Figure 4:
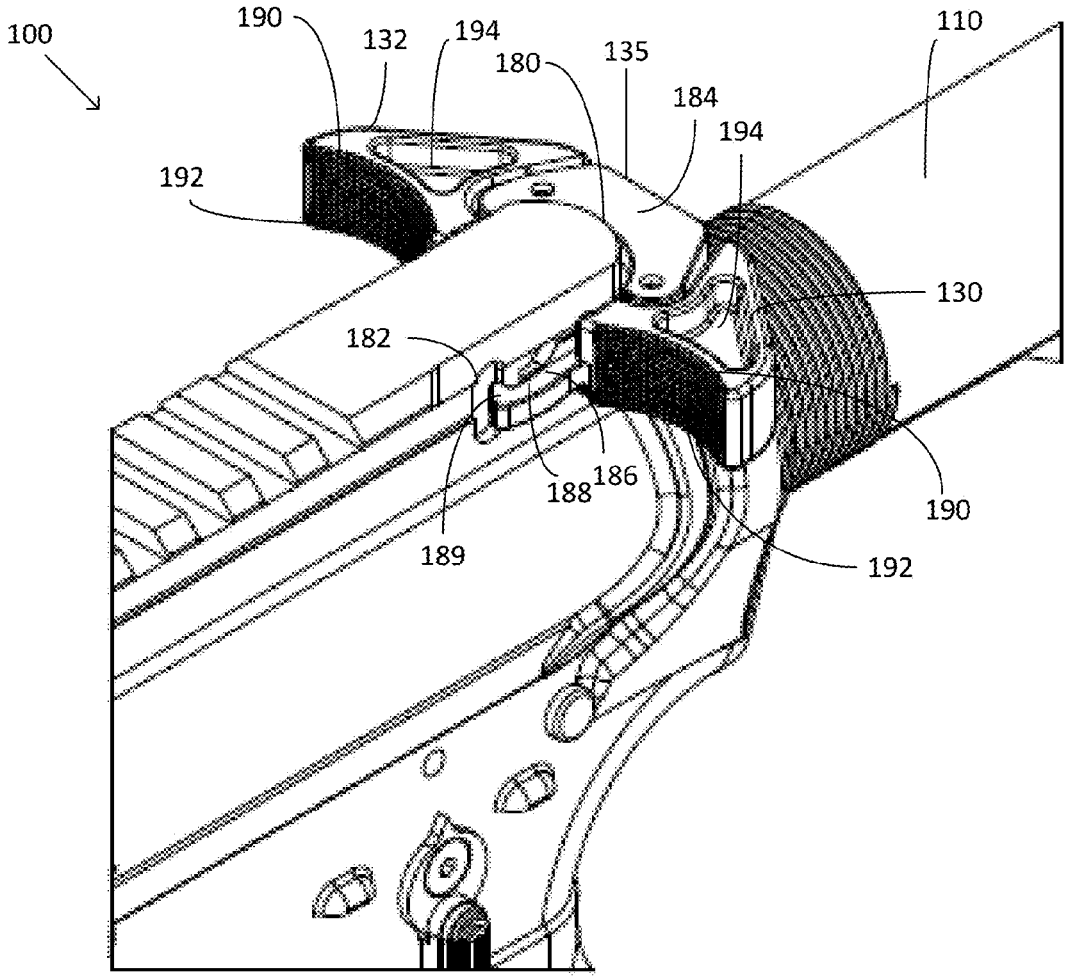
FIG. 4 is a perspective view of a further portion of the upper receiver of the firearm of FIG. 1 showing the charging handle of FIG. 1 in the relaxed position.

FIG. 4 is a perspective view of a further portion of the upper receiver 102 of the firearm 100 of FIG. 1 showing the charging handle 108 in the relaxed position. The firearm 100 includes the buffer tube 110, and the charging handle 108 includes the first lever 130, the second lever 132 and the back end 135 as discussed above. In addition, in this example the upper receiver 102 includes a back end 180 and a latch depression 182; the charging handle includes a body 184 and a latch 186 having a hook arm 188 and a hook 189; and each of the first lever 130 and the second lever 132 includes an arcuate front surface 190, grips 192, and a cutout 194.

The latch depression 182 is disposed on a side of the upper receiver 102 towards the back end 180 and receives the hook 189 of the latch 186, the hook 189 projecting sideways from the hook arm 188. When the hook 189 engages the latch depression 182, the charging handle 108 is prevented from moving rearwards and is effectively locked in position relative to the upper receiver 102. Latching the charging handle 108 to the upper receiver 102 helps to prevent inadvertent or undesired actuation of the charging handle 108.

The body 184 is disposed behind the central shaft 134 (FIG. 3), the central shaft 134 extending forwardly from the body 184. The first lever 130 and the second lever 132 are pivotally coupled to the body 184 on either side, respectively, of the body 184.

The latch 186 is partially nested within the first lever 130, with the hook 189 of the latch 186 extending forwards beyond the first lever 130 sufficiently to engage the latch depression 182 when the charging handle 108 is in a relaxed position.

The arcuate front surfaces 190 and the grips 192 assist the shooter in engaging the first lever 130 and/or the second lever 132 (e.g., with one or more fingers or a hand) by pressing up against one or both of the arcuate front surfaces 190 aided by the grips 192. As discussed in greater detail below, applying at least a predetermined threshold force rearwards (e.g., with one or more fingers or a hand) on the first lever 130, the second lever 132, or both the first lever 130 and the second lever 132, releases the latch 186 from the latch depression 182, allowing the charging handle 108 to be pulled rearwards to its pulled position.

Optionally one or more cutouts 194 are machined or cast into the upper side of one or both the first lever 130 and the second lever 132. The cutouts 194 provide an aesthetic look to the charging handle 108. In addition, the cutouts 194 may be used as finger holds (e.g., instead of the arcuate front surface 190) for the user to engage the first lever 130 and/or the second lever 132. Furthermore, the cutouts 194 reduce the overall weight of, and may also reduce the amount of material required to manufacture, the charging handle 108. In the example shown in FIG. 4, each of the first lever 130 and the second lever 132 includes an approximately triangular shaped cutout 194, the triangular shape having one or more rounded sides and rounded corners.

Figure 5:
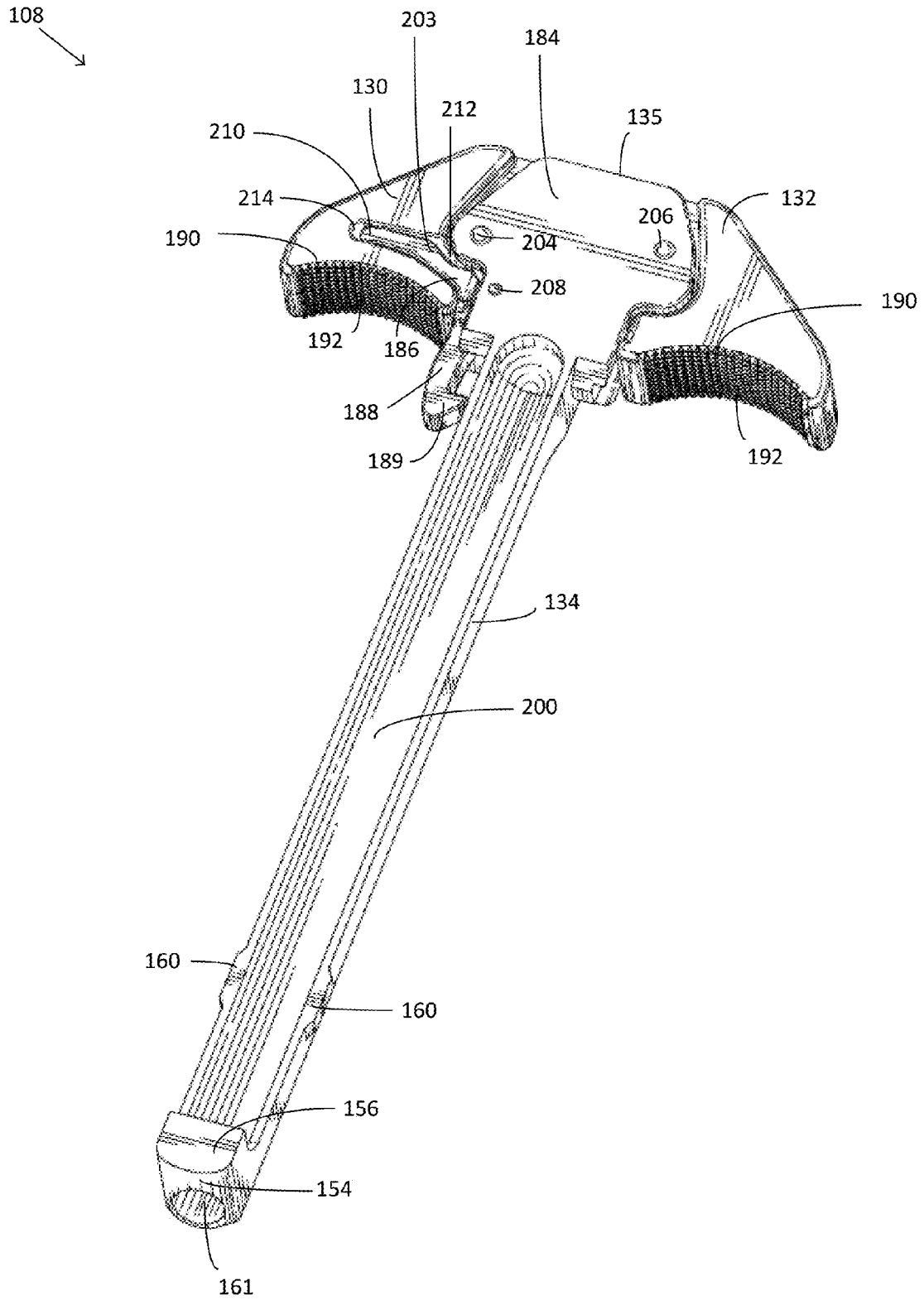
FIG. 5 is a bottom perspective view of the charging handle of FIG. 1 showing the latch in a relaxed position.

FIG. 5 is a bottom perspective view of the charging handle 108 of FIG. 1 showing the latch 186 in a relaxed position. In the relaxed position, the latch 186 is engageable with the latch depression 182 (FIG. 4). The charging handle 108 includes the first lever 130, the second lever 132, the central shaft 134, the back end 135, the front end 154, the bolt assembly engaging portion 156, the side alignment engagement mechanisms 160, the aperture 161, the body 184 the latch 186 having the hook arm 188, the hook 189, the arcuate front surfaces 190, and the grips 192 as discussed above. In addition, in this example, the central shaft 134 includes a longitudinal groove 200; the first lever 130 includes a latch slot 202; the latch 186 includes a latch arm 203 having a free end 210; and the body 184 includes a first pivot 204, a second pivot 206 and a latch pivot 208.

The longitudinal groove 200 receives a biasing mechanism (e.g., a spring) allowing for reciprocating forwards movement of the charging handle 108 relative to the upper receiver 102 (FIG. 3) along the direction of the bias after the charging handle 108 has been released by the shooter, as discussed in greater detail above in connection with FIG. 3.

The latch slot 202 is a cast or machined indentation in the first lever 130 and is sufficiently deep to securely receive the latch arm 203. The latch slot 202 is thus an integral component of the first lever 130 and moves (e.g., pivots) in conjunction with the moving (e.g., pivoting) of the first lever 130. In some examples, the latch arm 203 is perpendicular or substantially perpendicular to the hook arm 188 and extends from the hook arm 188 in a direction away from or substantially away from the body 184. The shape and size of the latch slot 202 generally follows the configuration of the latch arm 203 and, in some examples, a portion of the hook arm 188 as well.

In some examples, additional space is provided in the latch slot 202 to allow some independent movement of the latch arm 203 within the latch slot 202. Providing additional space in the latch slot 202 in this manner when the latch 186 is in the relaxed position (e.g., additional space 212 between the body 184 and the latch arm 203, and/or additional space 214 between the free end 210 of the latch arm 203 and the end of the latch slot 202) may also prevent the latch 186 from undesirably catching on or otherwise interfering with the body 184 when attempting to release the hook 189 from the latch depression 182, as such interference could prevent fluid and/or complete release of the hook 189. Reducing interference between portions of the latch 186 and the body 184 can thus facilitate operation of the charging handle 108 and reduce the amount of force required to release the latch from the relaxed position when pulling rearward on one or both of the first lever 130 and the second lever 132.

The first pivot 204 pivotally couples the body 184 to the first lever 130. The second pivot 206 pivotally couples the body 184 to the second lever 132. The latch pivot 208 pivotally couples the body 184 and the latch 186. Each of the first pivot 204, the second pivot 206 and the latch pivot 208 can be any suitable pivoting mechanism. Such a pivoting mechanism may be, for example, a pin disposed in a bore, the bore extending through the body 184 and a correspondingly aligned portion of the first lever 130, the second lever 132, and the latch 186, respectively, the pin thereby coupling the body 184 to the first lever 130, the second lever 132 and/or the latch 186, respectively in a rotational configuration about the pin. In some examples, the first pivot 204 and the latch pivot 208 are laterally displaced relative to each other as discussed in greater detail in connection with FIG. 9. For example, in FIG. 5, the latch pivot 208 is disposed inward (i.e., laterally closer to the central shaft 134) of the first pivot 204.

Figure 6:
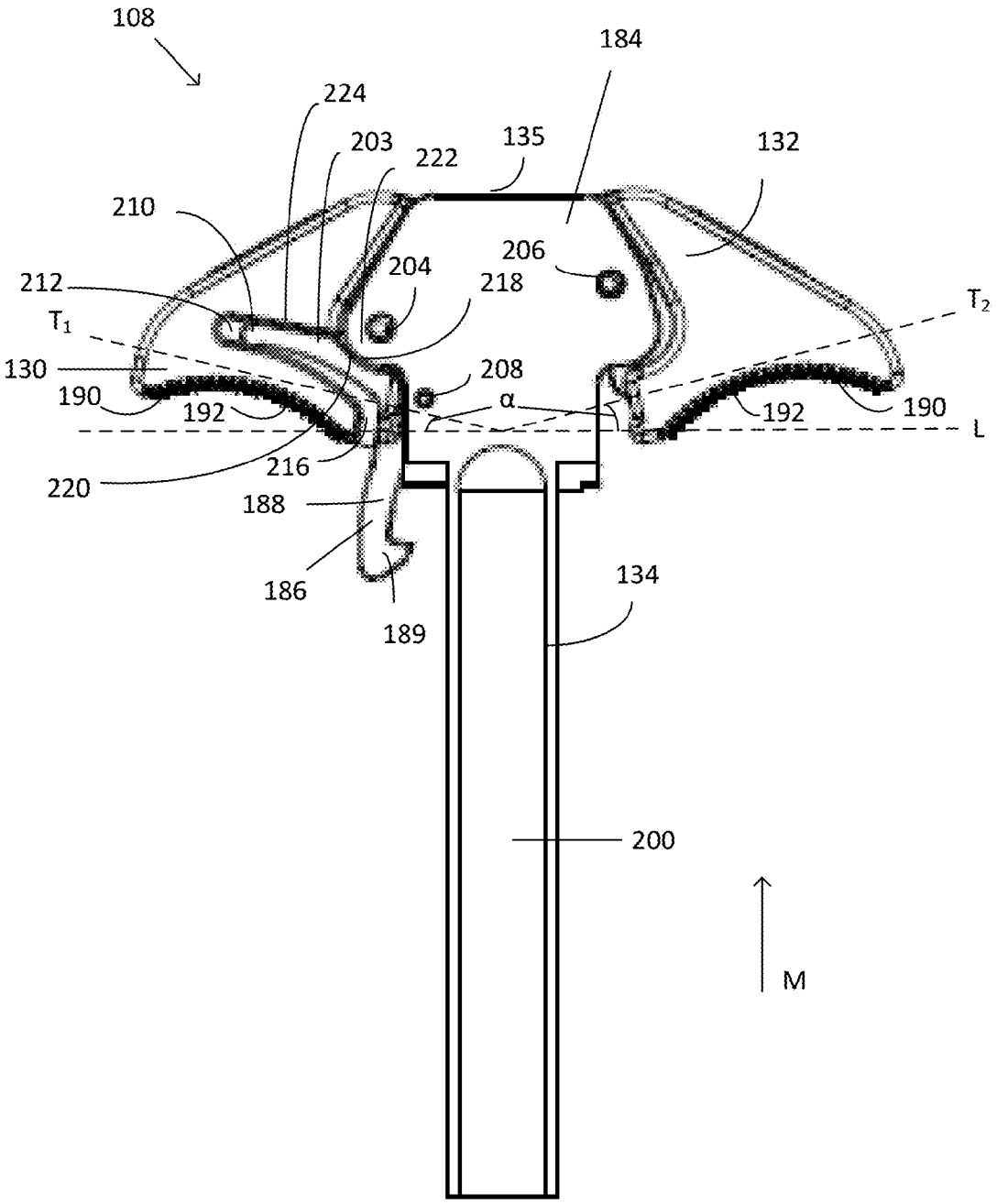
FIG. 6 is a bottom view of a rear portion of the charging handle of FIG. 1 showing the latch in a released position.

FIG. 6 is a bottom view of a rear portion of the charging handle 108 of FIG. 1 showing the latch 186 in a released position. In the released position, the latch 186 is disengaged from the latch depression 182 (FIG. 4). The charging handle 108 includes the first lever 130, the second lever 132, the central shaft 134, the back end 135, the body 184, the latch 186 having the hook arm 188 and the hook 189; the arcuate front surfaces 190, the grips 192, the longitudinal groove 200; the latch slot 202, the latch arm 203, the first pivot 204, the second pivot 206, the latch pivot 208 and the free end 210 of the latch arm 203.

Comparing FIG. 6 to FIG. 5, due to the shape and size of the latch 186 as compared with the latch slot 202, the positioning of the latch 186 within the latch slot 202 changes when the latch 186 is moved from the relaxed position (FIG. 5) to the released position (FIG. 6). For example, in the released position, the additional space 214 between the free end 210 of the latch 186 and the end of the latch slot 202 increases, while the additional space 212 (FIG. 5) between the body 184 and the latch arm 203 is reduced or eliminated and further additional space 216 opens up between the latch arm 203 and the first lever 130. As the hook 189 pivots away from the central shaft 134, the latch arm 203 eventually contacts the body 184 along a contact junction 218 formed by the nesting of a curved convex protrusion 222 in the body 184 in a correspondingly curved concave recess 220 in the latch arm 203. At the same time, a contact junction 224 forms between the latch arm 203 and the first lever 130. The contact junctions 218 and 224 prevent further pivoting movement of the latch 186, the first lever 130 and the second lever 132 away from the relaxed position of the latch 186.

In the fully released position of the latch 186 shown in FIG. 6, there is an angle $\alpha$ between the line $T_1$ tangent to the arcuate front surface 190 of the first lever 130 and the line L perpendicular to the direction of the rearward direction M of the charging handle 108. Likewise the angle $\alpha$ also exists between the line $T_2$ tangent to the arcuate front surface 190 of the second lever 132 and the line L. The angle $\alpha$ is relatively small to help direct the user's pulling force along the desired direction of motion M of the charging handle 108. In some examples a is in a range from about −30° to about 30°. In other examples, a is in a range from about −15° to about 15°. In a specific example, a is about 10°. In alternative examples, the angle between L and $T_2$ is greater or less than the angle between L and $T_1$ (i.e., the second lever 132 rotates to a greater or lesser degree than first lever 130 from the latch relaxed position to the latch released position).

Figure 7:
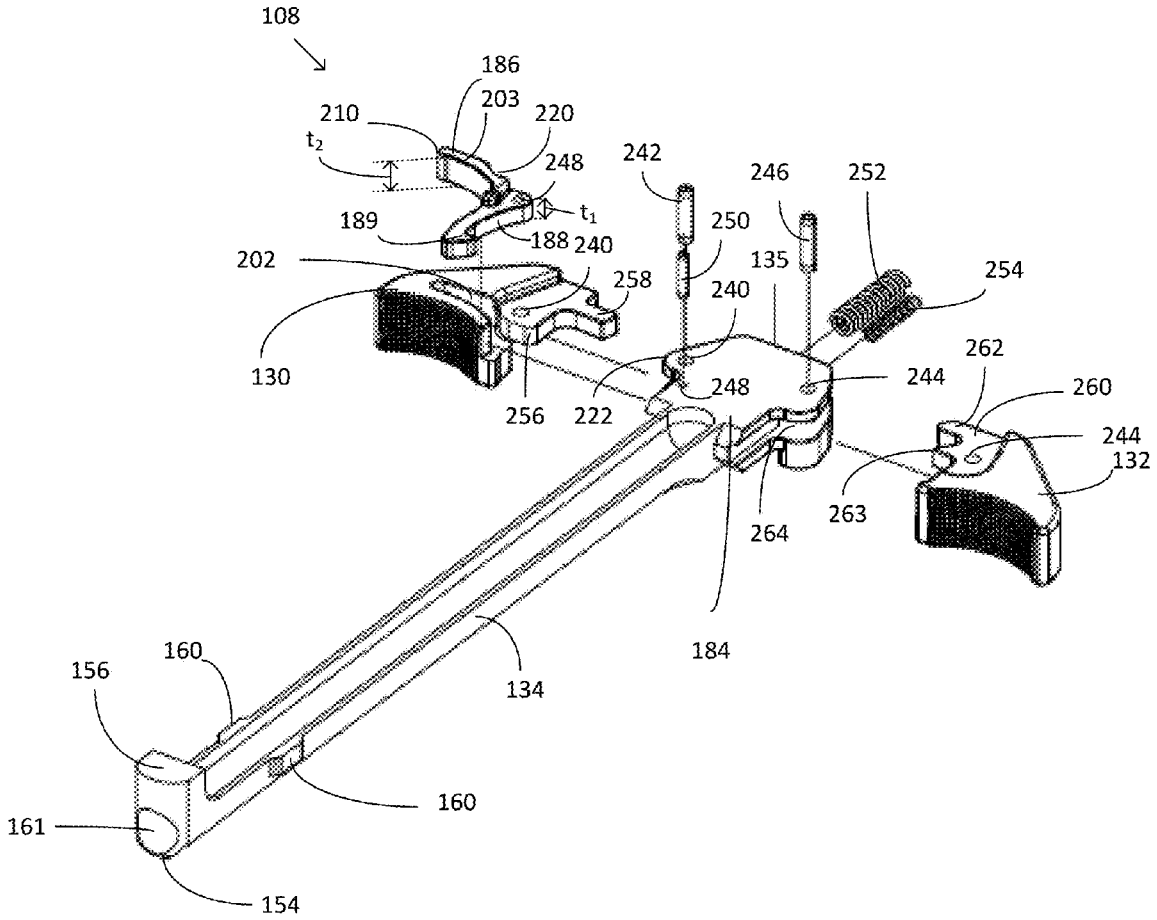
FIG. 7 is an exploded perspective view of the charging handle of FIG. 1.

FIG. 7 is an exploded perspective view of the charging handle 108 of FIG. 1. The charging handle 108 includes the first lever 130, the second lever 132, the central shaft 134, the back end 135, the front end 154, the bolt assembly engaging portion 156, the side alignment engagement mechanisms 160, the aperture 161, the body 184 having the curved convex protrusion 222, the latch 186 having the latch arm 203 with the free end 210 and the curved concave recess 220, the hook arm 188 and the hook 189; and the latch slot 202, as discussed above. Also in this example, the first pivot 204 (FIG. 5) includes a first bore 240 and a first pin 242; the second pivot 206 (FIG. 5) includes a second bore 244 and a second pin 246; and the latch pivot 208 (FIG. 5) includes a third bore 248 and a third pin 250. In addition, in this example the charging handle 108 includes a primary biasing mechanism 252 (e.g., a spring, a polymer rod) and a secondary biasing mechanism 254 (e.g., a spring, a polymer rod); the first lever 130 includes a first plate 256 and a first projection 258; the second lever includes a second plate 260, a second projection 262, and a third projection 263; and the body 184 includes a receiving area 264.

In an assembled position, the first plate 256 and the second plate 260 are disposed within the receiving area 264 (e.g., a groove) such that the first bore 240 aligns through the body 184 and the first plate 256, and the first pin 242 is disposed within the first bore 240, the first pin 242 cooperating with the first bore 240 to allow pivotal movement of the first lever 130 about the first pin 242. Similarly, the second bore 244 aligns with and through the body 184 and the second plate 260, and the second pin 246 is disposed within second bore 244, the second pin 246 cooperating with the second bore 244 to allow pivotal movement of the second lever 132 about the second pin 246. Similarly, the third bore 248 aligns with and through the body 184 and the latch 186, and the third pin 250 is disposed within the third bore 248 to allow pivotal movement of the latch 186 about the third pin 250.

The primary biasing mechanism 252 is disposed in a cavity within the body 184. A rear end of the primary biasing mechanism 252 engages the first projection 258. Applying sufficient rearward force to the first lever 130 and, in some examples, also or alternatively the second lever 132 causes the primary biasing mechanism 252 to compress within its cavity, resulting in a biasing force that urges the first lever 130 (and in some examples the second lever 132) to return to the relaxed position upon sufficient decrease in the force applied by the shooter.

The secondary biasing mechanism 254 is also disposed in a cavity within the body 184. A rear end of the secondary biasing mechanism 254 engages the third projection 263.

Applying sufficient rearward force to the second lever 132 causes the secondary biasing mechanism 254 to compress within its cavity, resulting in a biasing force that urges the second lever 132 to return to the relaxed position upon sufficient decrease in the force applied by the shooter.

In some examples, the second projection 262 is disposed rearward of the first projection 258 and engages the first projection 258 such that when a sufficient rearward force is applied to the second lever 132, the second projection 262 pushes forward on the first projection 258, which in turn causes a compression in the primary biasing mechanism 252 along with a pivoting of the first lever 130 and the latch 186 away from the relaxed position and towards the released position. Thus, in such a configuration, the latch 186 may be released from the upper receiver 102 (FIG. 1) by alternatively applying force rearwards on the first lever 130, the second lever 132, or both levers 130 and 132.

The hook arm 188 has a thickness $t_1$. The latch arm 203 has a thickness $t_2$. In some examples $t_1$ is less than $t_2$; $t_1$ is sufficiently small such that at least a portion of the hook arm 188 can be received by the receiving area 264 in the body 184 for proper assembly of the latch pivot (FIG. 5); and $t_2$ is sufficiently large to provide adequate strength to the latch arm 203 to hold up to the forces applied by the latch slot 202 during actuation of the charging handle 108.

Figure 9:
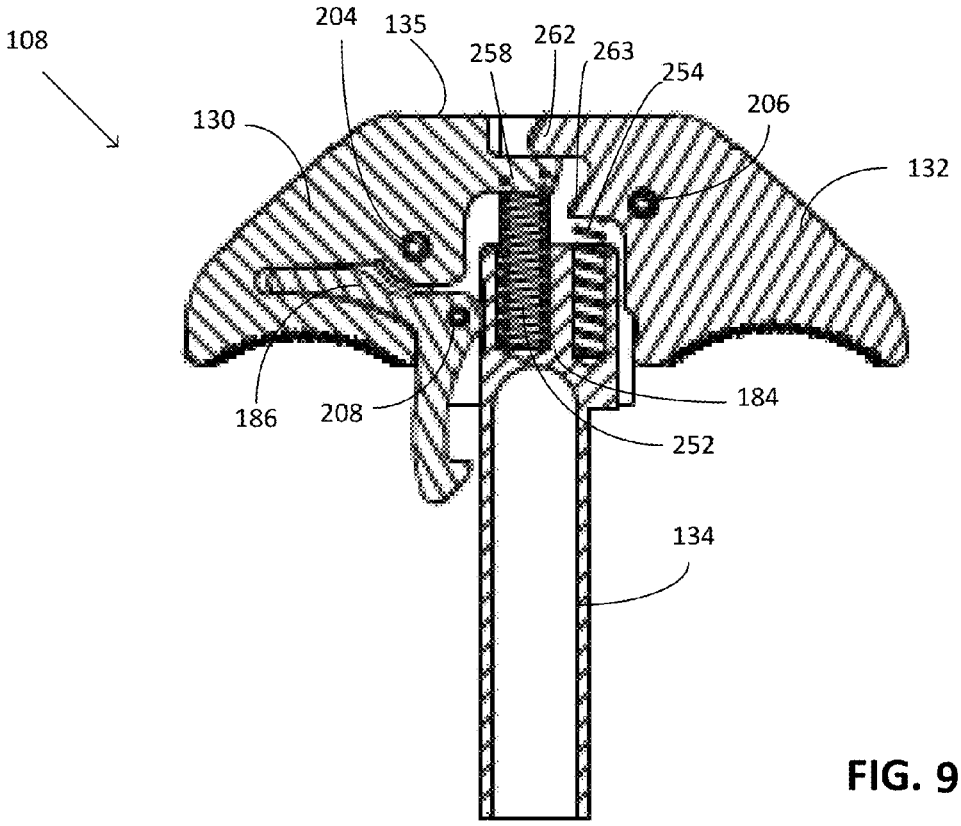
FIG. 9 is a cross-sectional view of a rear portion of the charging handle of FIG. 1 along the line A-A in FIG. 8.
Figure 8:
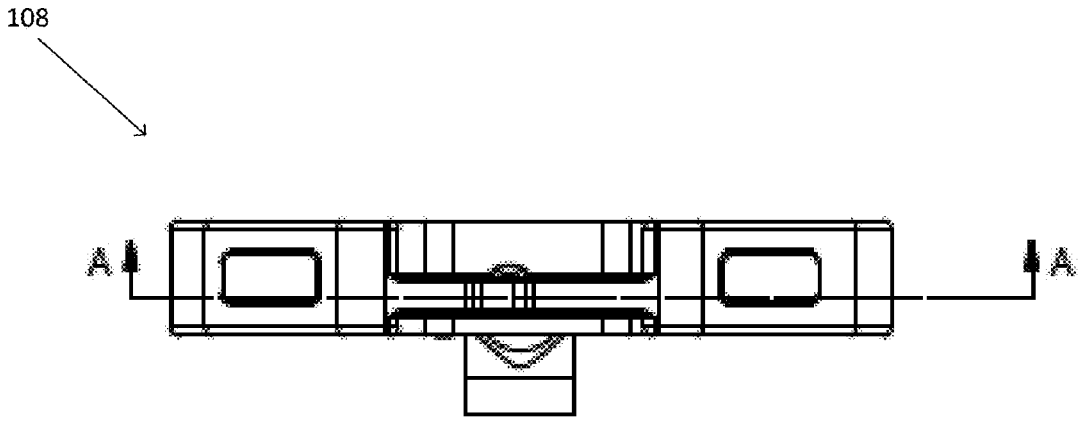
FIG. 8 is a rear view of the charging handle of FIG. 1.

FIG. 8 is a rear view of the charging handle 108 of FIG. 1. FIG. 9 is a cross-sectional view of a rear portion of the charging handle 108 along the line A-A in FIG. 8. With reference to FIG. 9, the charging handle 108 includes the first lever 130, the second lever 132, the central shaft 134, the back end 135, the body 184, the latch 186, the first pivot 204, the second pivot 206, the latch pivot 208, the primary biasing mechanism 252, the secondary biasing mechanism 254, the first projection 258, the second projection 262, and the third projection 263 as discussed above.

As shown in FIG. 9, the primary biasing mechanism 252 is disposed in a cavity in the body 184 having a closed forward end, the rear end of the primary biasing mechanism 252 being compressibly engaged by the first projection 258. The secondary biasing mechanism 254 is also disposed in a cavity in the body 184 having a closed forward end, the rear end of the secondary biasing mechanism 254 being compressibly engaged by the third projection 263. In addition, in this example, the second projection 262 is disposed rearwards of the first projection 258 and forwardly engages the first projection 258, thereby coupling the pivotal mobility of the first lever 130 and the latch 186 with the pivotal motion of the second lever 132 and providing for an ambidextrously operable charging handle 108.

In the example charging handle 108 of FIG. 9, the latch pivot 208 is disposed closer to the longitudinal central axis $A_1$ of the charging handle 108 than is the first pivot 204. In addition the latch pivot 208 is disposed forwards (i.e., farther away from the back end 135 of the charging handle 108) than the first pivot 204. The second pivot 206 is disposed rearwards (i.e., closer to the back end 135 of the charging handle 108) than both the first pivot 204 and the latch pivot 208. The relative longitudinal and latitudinal positioning of the first pivot 204, the second pivot 206, and the latch pivot 208 are selected to provide the desired pivotal motion of the associated component parts (e.g., without being blocked or interfered with by other component parts during the desired pivoting), while resulting in sufficient or optimal torque per unit force by the user/shooter to operate the charging handle 108 by pivoting the first lever 130 and/or the second lever 132 and releasing the latch 186.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A firearm charging handle comprising:

a front end;

a back end;

a body;

a central shaft extending forwardly from the body, the central shaft being configured to engage a bolt assembly;

a first lever pivotally coupled directly to the body and comprising an integrated slot therein, the slot pivoting in conjunction with the first lever; and a latch, the latch having a relaxed position and a released position and comprising a latch arm and a hook arm extending from the latch arm, at least a portion of the latch arm being disposed within the slot of the first lever;

wherein pivoting of the first lever pivots the latch arm within the slot; and wherein pivoting of the first lever moves the latch between the relaxed position and the released position.

2. The firearm charging handle of claim 1, wherein the hook arm comprises a hook for removably engaging a depression in an upper receiver of the firearm.

3. The firearm charging handle of claim 2, wherein the latch arm has a thickness that is greater than a thickness of the hook arm.

4. The firearm charging handle of claim 1, wherein the latch arm comprises a curved concave recess and the body comprises a curved convex protrusion that nests within the curved concave recess when the latch is in the released position.

5. The firearm charging handle of claim 4 further comprising a gap in the slot between the curved concave recess and the curved convex protrusion when the latch is in the relaxed position.

6. The firearm charging handle of claim 1 further comprising a second lever, the second lever being pivotally coupled to the body and coupled to the first lever.

7. The firearm charging handle of claim 1, wherein the latch arm extends from the hook arm in a direction that is substantially away from the body.

8. The firearm charging handle of claim 1, wherein pivoting the first lever moves the latch from the relaxed position to the released position against the bias of no more than one biasing mechanism.

9. The firearm charging handle of claim 6, wherein pivoting the second lever moves the latch from the relaxed position to the released position against the biases of no more than two biasing mechanisms.

10. A firearm charging handle comprising:

a front end;

a back end;

a body;

a central shaft extending forwardly from the body, the central shaft being configured to engage a bolt assembly;

a first lever comprising a first pivot and a latch at least partially disposed within the first lever, the latch having a second pivot, a relaxed position and a released position, the first lever being pivotally coupled to the body about the first pivot, the latch being pivotally coupled to the body about the second pivot; and a second lever comprising a third pivot, the second lever being pivotally coupled to the body about the third pivot;

wherein the third pivot is disposed rearward of the first pivot and of the second pivot;

wherein the second pivot is disposed nearer the central shaft than the first pivot and the third pivot; and wherein pivoting of the first lever or the second lever moves the latch between the relaxed position and the released position.

11. The firearm charging handle of claim 10, wherein the first lever comprises a first projection, wherein the second lever comprises a second projection, wherein the second projection is disposed rearward of the first projection, and wherein the second projection forwardly engages the first projection when the second lever is pivoted to move the latch from the relaxed position to the released position.

12. The firearm charging handle of claim 10, wherein the latch comprises a hook for removably engaging a depression in an upper receiver of the firearm.

13. The firearm charging handle of claim 10, wherein the first lever comprises an integrated slot therein, the slot pivoting in conjunction with the first lever; wherein the latch comprises a latch arm and a hook arm extending from the latch arm, at least a portion of the latch arm being disposed within the slot; and wherein the latch arm has a thickness that is greater than a thickness of the hook arm.

14. The firearm charging handle of claim 13, wherein the latch arm comprises a curved concave recess and the body comprises a curved convex protrusion that nests within the curved concave recess when the latch is in the released position.

15. The firearm charging handle of claim 14 further comprising a gap in the slot between the curved concave recess and the curved convex protrusion when the latch is in the relaxed position.

16. The firearm charging handle of claim 13, wherein the latch arm extends from the hook arm in a direction that is substantially away from the body.

17. The firearm charging handle of claim 10, wherein pivoting the first lever moves the latch from the relaxed position to the released position against the bias of no more than one biasing mechanism.

18. The firearm charging handle of claim 10, wherein pivoting the second lever moves the latch from the relaxed position to the released position against the biases of no more than two biasing mechanisms.

19. The firearm charging handle of claim 11, wherein the second lever further comprises a third projection that engages a biasing mechanism.

20. A firearm comprising:

an upper receiver;

a bolt assembly disposed within the upper receiver; and a charging handle, the charging handle comprising:

a front end;

a back end;

a body;

a central shaft extending forwardly from the body, the central shaft being configured to engage the bolt assembly and being at least partially housed in the upper receiver;

a first lever comprising a first pivot and a latch, the latch having a second pivot, a latch arm, a hook arm extending from the latch arm, a relaxed position and a released position, the first lever further comprising an integrated slot therein, the first lever being pivotally coupled to the body about the first pivot, the latch being pivotally coupled to the body about the second pivot, the slot pivoting in conjunction with the first lever; and a second lever comprising a third pivot, the second lever being pivotally coupled to the body about the third pivot;

wherein the third pivot is disposed rearward of the first pivot and of the second pivot; and wherein pivoting of the first lever or the second lever pivots the latch arm within the slot and moves the latch between the relaxed position and the released position.

* * * * *